US007744193B2

(12) United States Patent
Hack et al.

(10) Patent No.: US 7,744,193 B2
(45) Date of Patent: Jun. 29, 2010

(54) INCREASED DROPLET PLACEMENT ACCURACY IN INKJET PRINTING

(75) Inventors: Martinus Jacobus Johannes Hack, Eindhoven (NL); Johannes Nicolaas Huiberts, Eindhoven (NL)

(73) Assignee: TPO Displays Corp. (TW)

( * ) Notice: Subject to any disclaimer, the term of this patent is extended or adjusted under 35 U.S.C. 154(b) by 157 days.

(21) Appl. No.: 10/577,896

(22) PCT Filed: Oct. 25, 2004

(86) PCT No.: PCT/IB2004/052186

§ 371 (c)(1),
(2), (4) Date: May 1, 2006

(87) PCT Pub. No.: WO2005/042257

PCT Pub. Date: May 12, 2005

(65) Prior Publication Data

US 2007/0085878 A1 Apr. 19, 2007

(30) Foreign Application Priority Data

Nov. 4, 2003 (EP) ..... 03104067

(51) Int. Cl.
*B41J 2/14* (2006.01)

(52) U.S. Cl. ..... 347/47

(58) Field of Classification Search ..... 347/20, 347/47, 77, 78, 82
See application file for complete search history.

(56) References Cited

U.S. PATENT DOCUMENTS

| | | | | |
|---|---|---|---|---|
| 6,527,369 | B1 * | 3/2003 | Weber et al. | 347/47 |
| 6,527,370 | B1 * | 3/2003 | Courian et al. | 347/47 |
| 6,878,298 | B2 * | 4/2005 | Umehara | 216/27 |
| 6,938,988 | B2 * | 9/2005 | Clark et al. | 347/47 |

FOREIGN PATENT DOCUMENTS

| | | |
|---|---|---|
| CN | 1387480 A | 12/2002 |
| EP | 0792744 A2 | 9/1997 |
| EP | 1197335 | 4/2002 |

* cited by examiner

*Primary Examiner*—Stephen D Meier
*Assistant Examiner*—Alexander C Witkowski
(74) *Attorney, Agent, or Firm*—Raymond J. Ho; Morris Manning Martin

(57) ABSTRACT

The present invention relates to an inkjet print head (1) comprising at least one nozzle chamber (2), having a nozzle aperture (3) defined in one wall thereof for the ejection of printing fluid out of said aperture (3), and a printing fluid supply channel interconnected with said nozzle chamber (2). A printing fluid droplet tail release guide arrangement (4) is arranged at a predetermined position at an edge of a circumference of said aperture (3). The present invention further relates to a method for increasing droplet placement accuracy in an inkjet print head having at least one nozzle chamber with a nozzle aperture defined in one wall thereof for the ejection of printing fluid out of said aperture. The method comprises the step of providing a printing fluid droplet tail release guide arrangement at a predetermined position at an edge of a circumference of said aperture.

8 Claims, 5 Drawing Sheets

INCREASED DROPLET PLACEMENT ACCURACY IN INKJET PRINTING

BACKGROUND OF THE INVENTION

1. Field of the Invention

The present patent application relates to the field of inkjet printing, and particularly to inkjet printing for patterning in the manufacture of displays and electronics. Further, the present invention relates to an inkjet print head and a method for increasing droplet placement accuracy in such a print head.

2. Description of the Related Art

Most inkjet print heads used today have circular nozzle orifices. An ejected ink droplet usually has a tail, which in the ideal situation should be released from the center of the fluid. However, because there is a dynamic motion of the fluid in a fluidic column of the print head, a situation occurs which renders it unfavorable for the ink droplet to release from the center of the fluid. In the above described situation the release point of the ink droplets tail is probably located at the edge of the nozzle orifice. Due to the above described prior art orifices being circular, there is no particular reason for a tail of a droplet to favor one location or another on the periphery of the orifice to make its final departure from. Thus, this leads to the possibility of the tail break-off varying randomly from one side of the orifice to another due to the dynamic motion of the fluid in the fluidic column of the print head. This phenomenon might influence the trajectory of the ejected ink droplet, such that the ink droplet is expelled improperly and is delivered to an undesired location on the print media material, e.g. substrate. The place where the tail of the ink droplet is most likely to attach is the roughest edge of the nozzle orifice, which position can be located anywhere on the edge of the nozzle orifice, and can change over time as a result to unintended damage of the nozzle edge. This will cause a random deviation in the straightness of the droplet trajectory relative to a center line of the nozzle. This variation in tail break-off position is likely to lead directly to dot-placement errors.

Inkjet patterning technology can be used in the manufacture of so called polyLED color devices. The straightness of the droplet trajectory is a very important factor in ensuring high print quality in such applications. As an example, a typical ink droplet can have a diameter of 30 micrometers in flight and approximately 40 micrometers when landed on the print media material, e.g. substrate. Currently pixels of so called polyLED devices are approximately 50 to 60 micrometers wide, which leaves an error margin in pixel placement of only 5 to 10 micrometers. Taking the above into account, this means that the straightness of the droplet trajectory, i.e. the intended pathway to be followed by the ink droplet in order to created the final printed image pattern, is a very important factor in such patterning. In the case of patterning Light Emitting Polymers the interaction of polymer chains will cause a long filament tail as the droplet falls. This filament tail is likely to further influence the deviation of the ejected droplet from a direction along the center line of the nozzle when it does not hang from the middle of the fluidic column in the nozzle but on a non-defined part of the edge of the nozzle orifice. As mentioned above, this position can vary from nozzle to nozzle resulting in an intrinsic error, which cannot be influenced by changing the printing settings. In the case of patterning Light Emitting Polymers this might result in insufficient spacing between adjacent pixels.

Previously known patent publication U.S. Pat. No. 6,299,289 relates to an inkjet print head, typically constructed by a MEMS (Micro Electro Mechanical System) process, which includes a large number of nozzle chambers with ink ejection nozzle apertures and a paddle moveable in each chamber by an actuator to deliver ink through the nozzle. Each paddle is provided with a projecting poker, concentrically protruding through the nozzle aperture when actuated to inhibit clogging of the nozzle.

Although it is envisaged that a return movement of the actuator will result in a general necking and breaking of a meniscus around the poker to form a droplet a drawback of the above described print head according to U.S. Pat. No. 6,299,289 is that a filament tail of the droplet is likely to attach to an undefined position at the periphery of the poker, which, in the same manner as described above, is likely to cause a random deviation of the ejected droplet from a direction along the center line of the nozzle as the poker will need to be of a certain dimension in order to perform the intended function of inhibiting clogging of the nozzle. Further, as is evident from the drawings of U.S. Pat. No. 6,299,289, the peripheral portion of the distal free end of said poker will not be aligned with the center line of the nozzle aperture when actuated.

SUMMARY OF THE INVENTION

Taking the above into mind, it is an object of the present invention to provide an improved inkjet print head, by which increased droplet placement accuracy can be achieved.

This object is achieved in accordance with the characterizing portion of claim 1.

Thanks to the provision of a printing fluid droplet tail release guide arrangement having a predetermined position at an edge of a circumference of the nozzle aperture a defined area on the nozzle edge from which the printing fluid droplet tail will be released can be achieved thus providing increased control of the trajectory of an expelled printing fluid droplet relative to a direction along a center line of the nozzle.

A further object of the present invention is to provide a method for increasing the droplet placement accuracy of an inkjet print head.

This object is achieved in accordance with the characterizing portion of claim 13.

Thanks to the provision of a method step of providing a printing fluid droplet tail release guide arrangement at a predetermined position at an edge of a circumference of a nozzle aperture of said print head a defined area on the nozzle edge from which the printing fluid droplet tail will be released can be achieved thus providing increased control of the trajectory of an expelled printing fluid droplet relative to a direction along a center line of the nozzle.

Preferred embodiments are listed in the dependent claims.

BRIEF DESCRIPTION OF THE DRAWINGS

In the drawings, wherein like reference characters denote similar elements throughout the several views.

Still other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
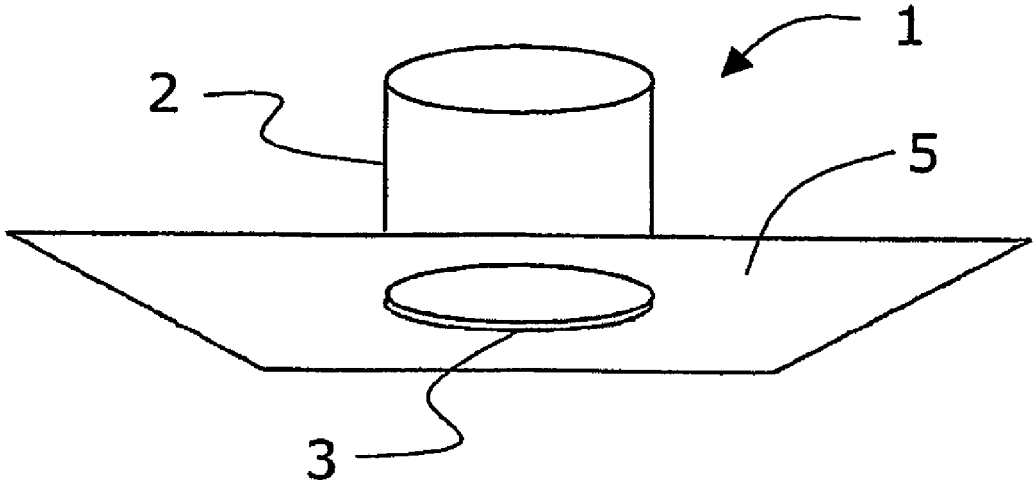
FIG. 1 discloses a schematic bottom view of a prior art print head comprising a spherical hole nozzle orifice in a nozzle plate.

FIG. 1 shows in a bottom view a schematic illustration of a prior art inkjet print head 1 comprising a nozzle chamber 2, having a nozzle aperture 3 defined in a nozzle plate 5 for the ejection of printing fluid out of said aperture 3. The aperture 3 orifice of this prior art print head nozzle consists of a spherical hole 3 in the nozzle plate 5. When an ejection pulse is applied to a fluid inside such a nozzle a dynamic motion occurs. Under the right conditions, e.g. pulse length and force applied, this will result in the formation of a droplet. In the ideal situation the fluid motion and the formation of the droplet are in sync and the droplet will be expelled from the nozzle aperture 3 along a center line thereof. The edge of the prior art nozzle aperture 3 is substantially uniform, which especially when printing polymeric ink, such as Light Emitting Polymers, might influence the direction of a main droplet randomly, as the interaction of polymer chains will cause a long filament tail as the droplet is ejected. The filament tail of said droplet, due to the dynamic motion of the fluid, is likely to adhere to the edge of the nozzle aperture 3 at a random position causing a random deviation in the straightness of the droplet, resulting in an intrinsic error which leads to decreased droplet placement accuracy. The above drawback cannot be influenced by changing the print settings.

As the droplets will leave the nozzle from random positions at the edge of the nozzle aperture 3 there is an increased risk of adjacent pixels interfering with each other at the printed substrate, which of course is especially undesirable when patterning devices such as polyLED devices.

In accordance with the present invention it is therefore suggested to provide a printing fluid droplet tail release guide arrangement 4 at a predetermined position at an edge of a circumference of the nozzle aperture 3 in an inkjet print head 1 for printing fluid, such as polymeric ink, comprising at least one nozzle chamber 2, having a nozzle aperture 3 defined in one wall thereof for the ejection of printing fluid out of said aperture 3 and a printing fluid supply channel (not shown) interconnected with said nozzle chamber 2. In this way a defined position on the edge of the nozzle aperture 3 is provided, from which a tail of a printing fluid droplet will be released. Through providing all the nozzles of the print head 1 with droplet tail release guide arrangements in corresponding positions, it is possible to ensure that the printing fluid droplets will provide printed pixels at positions of the substrate having essentially equal spacing. Consequently, this embodiment forces the tail to be expelled from the same position at the nozzle aperture 3 each time a droplet is ejected and therefore overcomes the tail break-off variations of the prior art inkjet print head nozzles.

Figure 2:
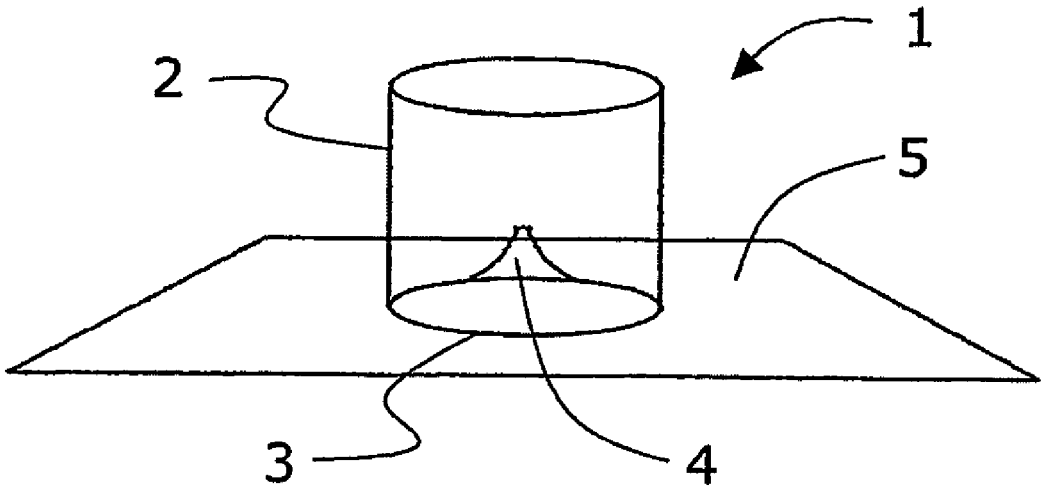
FIG. 2 discloses a schematic cross-section of a first embodiment of a droplet tail release guide arrangement in an inkjet print head.

A first embodiment of a printing fluid droplet tail release guide arrangement 4 is illustrated in FIG. 2, which shows a schematic cross-section of a nozzle where said printing fluid droplet tail release guide arrangement 4 comprises a pointed burr like element the point of which is directed inwards of said aperture 3. This burr like element provides a defined position at the edge of the nozzle aperture 3 from which the tail of the printing fluid droplet will be released.

Figure 3:
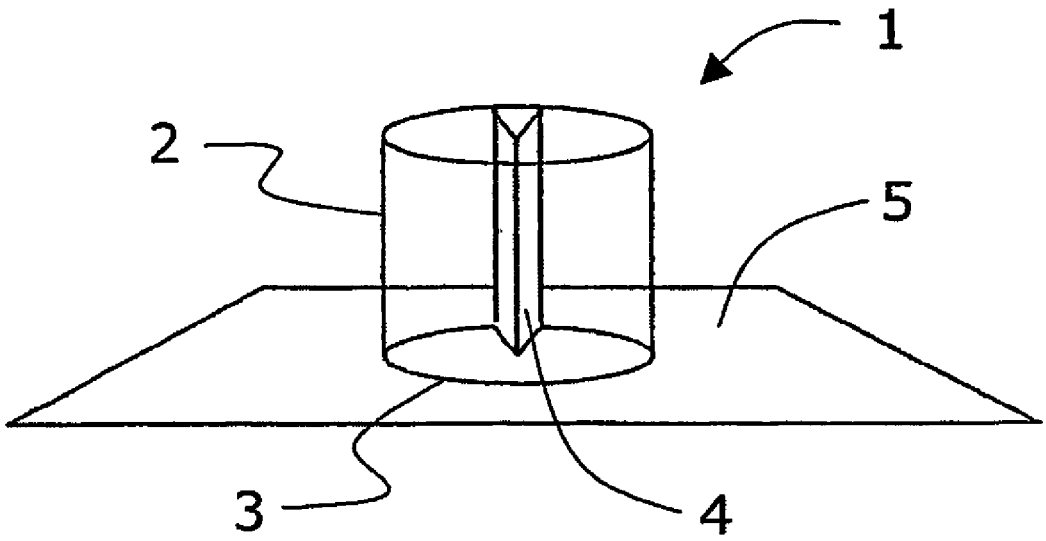
FIG. 3 discloses a schematic cross-section of a second embodiment of a droplet tail release guide arrangement in an inkjet print head.

A second embodiment is illustrated in FIG. 3, which shows a schematic cross-section of a nozzle where said printing fluid droplet tail release guide arrangement 4 comprises a bar of essentially triangular cross-section a base of which rests on an inner surface of said nozzle chamber 2 and a pointed edge of which protrudes towards the center of said aperture 3 said bar further extending along said inner surface inwards of said nozzle chamber 2. In corresponding fashion this bar provides a defined position on the edge of the nozzle aperture 3 from which the tail of the printing fluid droplet will be released.

Figure 4:
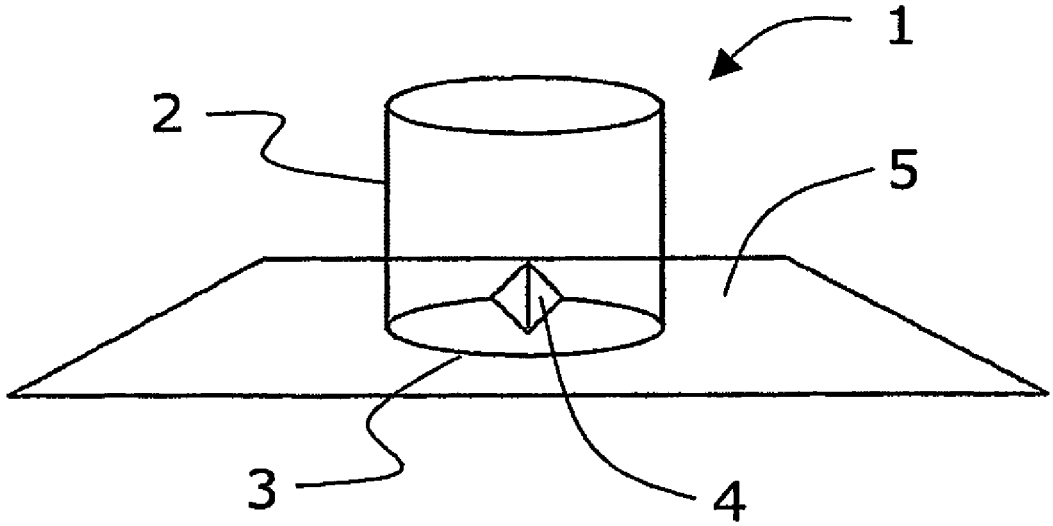
FIG. 4 discloses a schematic cross-section of a third embodiment of a droplet tail release guide arrangement in an inkjet print head.

FIG. 4 shows a schematic cross-section of a third embodiment of a nozzle where said printing fluid droplet tail release guide arrangement 4 comprises a pointed structure of essentially pyramidal shape a base of which rests on an inner surface wall of said nozzle chamber 2 and a pointed tip of which protrudes towards the center of said aperture 3. In corresponding fashion this structure provides a defined position on the edge of the nozzle aperture 3 from which the tail of the printing fluid droplet will be released.

Figure 5:
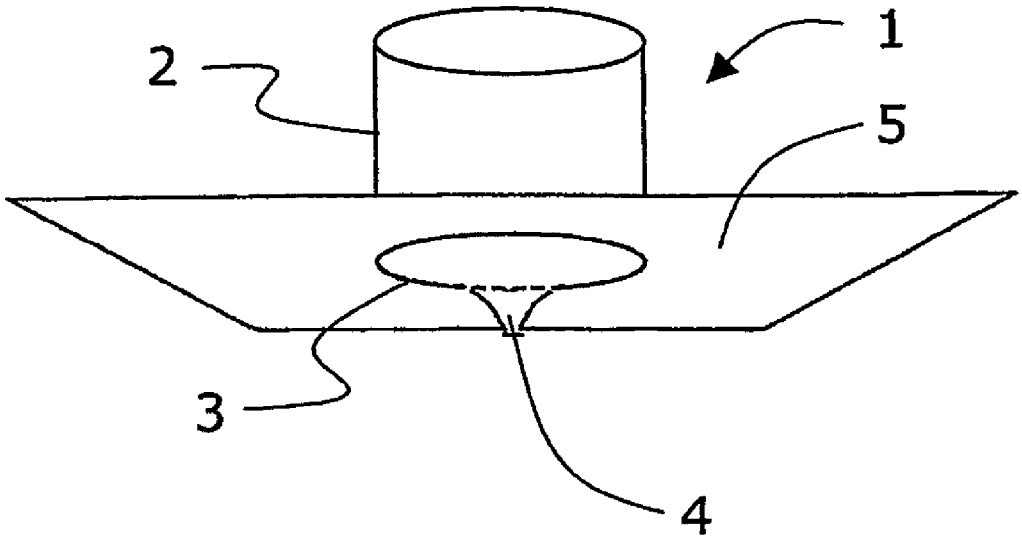
FIG. 5 discloses a schematic bottom view of a fourth embodiment of a droplet tail release guide arrangement in an inkjet print head.

A fourth embodiment is illustrated in FIG. 5, which shows a bottom view of a nozzle where said printing fluid droplet tail release guide arrangement 4 comprises a pointed burr like element the point of which is directed outwards of said aperture 3. This burr like element will guide the tail of the printing fluid droplet like the sharp needle of a syringe.

Figure 6:
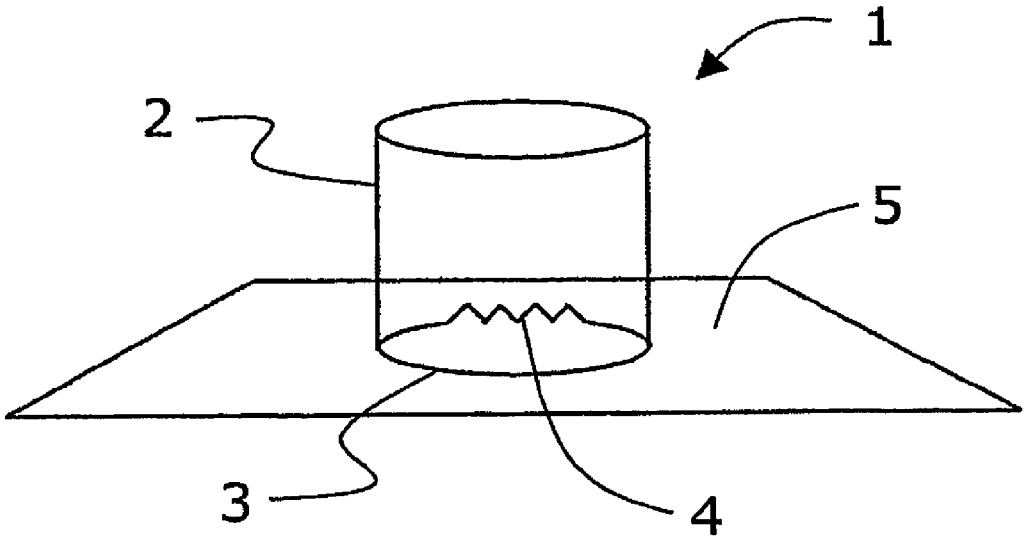
FIG. 6 discloses a schematic cross-section of a fifth embodiment of a droplet tail release guide arrangement in an inkjet print head.

Illustrated in FIG. 6 is a schematic cross-section of a fifth embodiment of a nozzle where said printing fluid droplet tail release guide arrangement 4 comprises an essentially saw tooth shaped section arranged at a portion of said edge of said circumference of said aperture 3. This saw tooth shaped section will provide a defined position on the edge of the nozzle aperture 3 from which the tail of the printing fluid droplet will be released.

Figure 7:
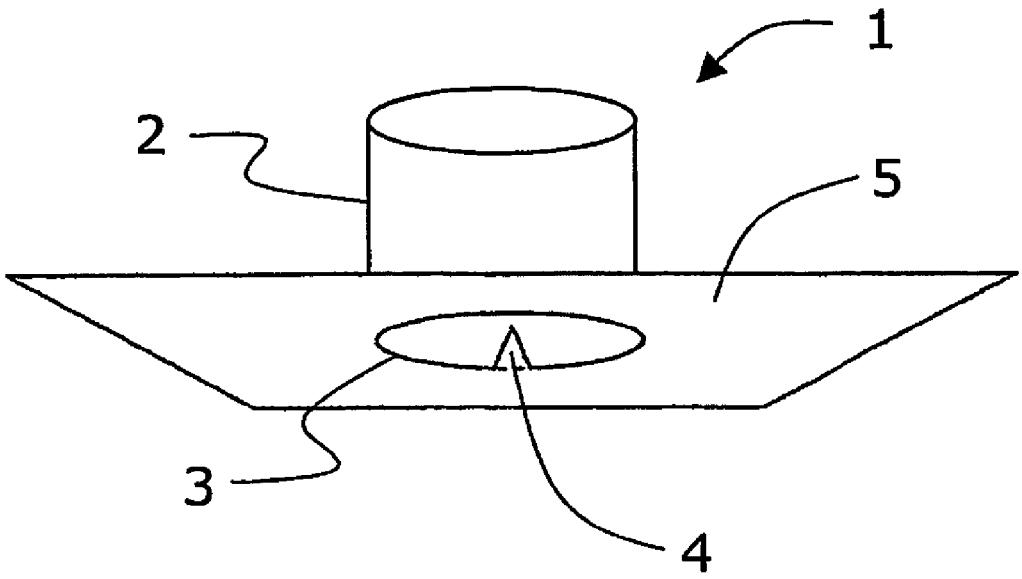
FIG. 7 discloses a schematic bottom view of a sixth embodiment of a droplet tail release guide arrangement in an inkjet print head.

FIG. 7 shows a bottom view of a sixth embodiment of a nozzle where said printing fluid droplet tail release guide arrangement 4 comprises a recessed section of essentially triangular shape in an inner surface wall of said nozzle chamber 2 a base of which rests in the plane of said aperture 3 and a point of which is directed inwards of said nozzle chamber 2. This recessed section will guide the tail of the printing fluid droplet to a predetermined release position.

Figure 8:
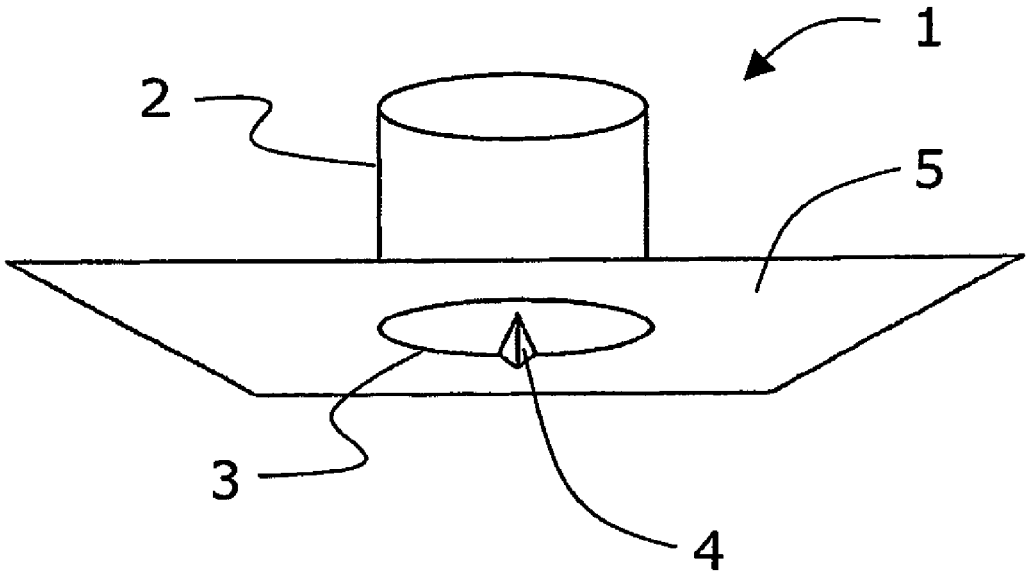
FIG. 8 discloses a schematic bottom view of a seventh embodiment of a droplet tail release guide arrangement in an inkjet print head.

In FIG. 8 is shown a bottom view of a seventh embodiment of a nozzle where said printing fluid droplet tail release guide arrangement 4 comprises a recessed section of essentially triangular pyramidal shape in an inner surface wall of said nozzle chamber 2 a base of which rests in the plane of said aperture 3 and a point of which is directed inwards of said nozzle chamber 2. This recessed section will guide the tail of the printing fluid droplet to a predetermined release position in corresponding manner as in the previous embodiments.

Figure 9:
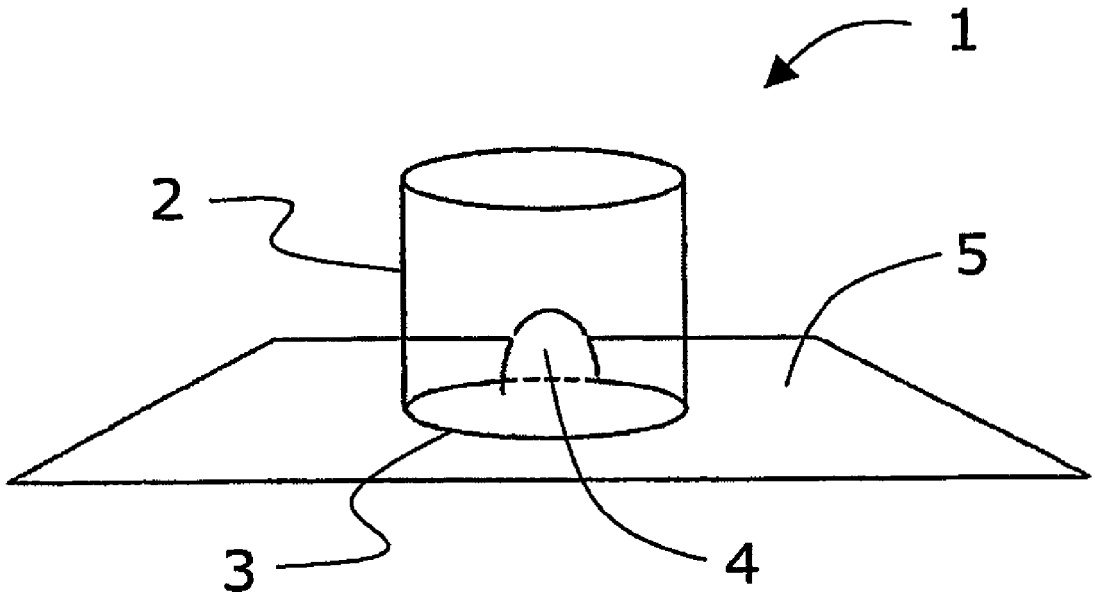
FIG. 9 discloses a schematic cross-section of a eight embodiment of a droplet tail release guide arrangement in an inkjet print head.

Illustrated in FIG. 9 is a schematic cross-section of an eight embodiment of a nozzle where said printing fluid droplet tail release guide arrangement 4 comprises a recessed section of essentially hemispherical shape in an inner surface wall of said nozzle chamber 2 a chord of which rests in the plane of said aperture 3 and an arc of which extend inwards of said nozzle chamber 2. This recessed section will guide the tail of the printing fluid droplet to a predetermined release position.

Figure 10:
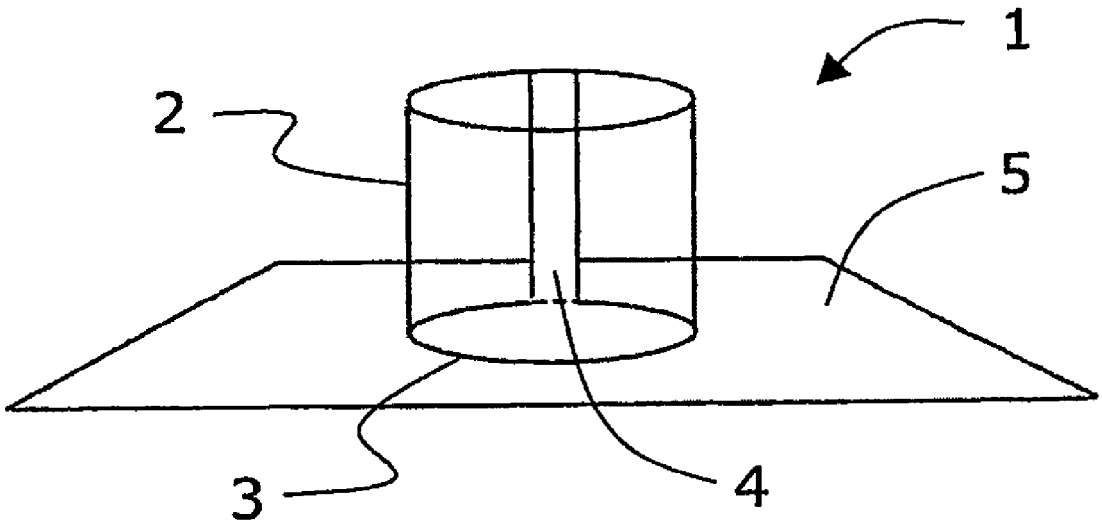
FIG. 10 discloses a schematic cross-section of a ninth embodiment of a droplet tail release guide arrangement in an inkjet print head.

FIG. 10 shows a schematic cross-section of a ninth embodiment of a nozzle where said printing fluid droplet tail release guide arrangement 4 comprises a recessed section of essentially rectangular shape extending from said aperture 3 inwards along an inner surface wall of said nozzle chamber 2. This recessed section will act like the tip of a fountain pen in guiding the tail of the printing fluid droplet to a predetermined release position.

A method for increasing droplet placement accuracy in an inkjet print head 1 having at least one nozzle chamber 2 with a nozzle aperture 3 defined in one wall thereof for the ejection of printing fluid out of said aperture 3 in accordance with the present invention comprises the step of providing a printing fluid droplet tail release guide arrangement 4 at a predetermined position at an edge of a circumference of said aperture 3.

In one embodiment the above method further comprises the step of providing as said printing fluid droplet tail release guide arrangement 4 a pointed burr like element such that the point thereof is directed inwards of said nozzle aperture 3.

In an alternative embodiment the above method further comprises the step of providing as said printing fluid droplet tail release guide arrangement 4 a bar of essentially triangular cross-section such that a base thereof will rest on an inner surface of said nozzle chamber 2 and such that a pointed edge thereof protrudes towards the center of said aperture 3 and directing said bar such that it extends along said inner surface inwards of said nozzle chamber 2.

In yet an alternative embodiment the above method further comprises the step of providing as said printing fluid droplet tail release guide arrangement 4 a pointed structure of essentially pyramidal shape such that a base thereof rests on an inner surface wall of said nozzle chamber 2 and such that a pointed tip thereof protrudes towards the center of said aperture 3.

In still an alternative embodiment the above method further comprises the step of providing as said printing fluid droplet tail release guide arrangement 4 a pointed burr like element such that a point thereof is will be directed outwards of said aperture 3.

In another alternative embodiment the above method further comprises the step of providing as said printing fluid droplet tail release guide arrangement 4 an essentially saw tooth shaped section at a portion of said edge of said circumference of said aperture 3.

In still another alternative embodiment the above method further comprises the step of providing as said printing fluid droplet tail release guide arrangement 4 a recessed section of essentially triangular shape in an inner surface wall of said nozzle chamber 2 such that a base thereof rests in the plane of said aperture 3 and a point thereof is directed inwards of said nozzle chamber 2.

In yet another alternative embodiment the above method further comprises the step of providing as said printing fluid droplet tail release guide arrangement 4 a recessed section of essentially triangular pyramidal shape in an inner surface wall of said nozzle chamber 2 such that a base thereof rests in the plane of said aperture 3 and a point thereof is directed inwards of said nozzle chamber 2.

In still yet another alternative embodiment the above method further comprises the step of providing as said printing fluid droplet tail release guide arrangement 4 a recessed section of essentially hemispherical shape in an inner surface wall of said nozzle chamber 2 such that a chord thereof rests in the plane of said aperture 3 and an arc thereof extend inwards of said nozzle chamber 2.

In a further alternative embodiment the above method further comprises the step of providing as said printing fluid droplet tail release guide arrangement 4 a recessed section of essentially rectangular shape such that it extends from said aperture 3 inwards along an inner surface wall of said nozzle chamber 2.

For example, representative construction methods that can be employed to produce the claimed printing fluid droplet tail release guide arrangement 4 include electroforming, laser ablation, electro-discharge machining, micropunching, laser drilling, anisotropy etching, etching, molding, kerfing as well as other chemical etching methods and physical processing techniques such as stamping, cutting, milling, drilling, sand blasting, deposition, casting, and similar known processes. Localized heat treatment could also be used to "deform" the appropriate area to produce the claimed printing fluid droplet tail release guide arrangement 4. It is also possible to produce a printing fluid droplet tail release guide arrangement 4 through locally changing the roughness of a portion of the circumference of the nozzle aperture 3. Moreover, the material used for the fluid droplet tail release guide arrangement 4 does not have to be the same material as the material of the nozzle plate 5, but can be another material which has been deposited thereon or attached thereto in any kind of way.

Accordingly, a number of conventional procedures can be employed without limitation for the purposes described above.

The present invention shall also encompass a print cartridge encompassing the droplet tail release guide arrangement 4 in accordance with the present invention as well as an inkjet printing device encompassing said droplet tail release guide arrangement 4.

Further, it will be evident to the person skilled in the art that an inkjet print head usually comprises a plurality of interspaced nozzles and that through providing all the nozzles of such a print head with printing fluid droplet tail release guide arrangements 4 in corresponding positions, it is possible to assure that the printing fluid droplets will provide printed pixels at positions of the substrate having essentially equal spacing.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An inkjet print head comprising: at least one nozzle chamber, having a nozzle aperture defined in one wall thereof for the ejection of printing fluid out of said aperture, a printing fluid supply channel interconnected with said nozzle chamber; and a printing fluid droplet tail release guide arrangement having disposed on a predetermined position of an edge of a circumference of said aperture, wherein said printing fluid droplet tail release guide arrangement comprises a bar of essentially triangular cross-section a base of which rests on an inner surface of said nozzle chamber and a pointed edge of which protrudes towards the center of said aperture said bar further extending along said inner surface inwards of said nozzle chamber.

2. An inkjet print head comprising: at least one nozzle chamber, having a nozzle aperture defined in one wall thereof for the ejection of printing fluid out of said aperture, a printing fluid supply channel interconnected with said nozzle chamber; and a printing fluid droplet tail release guide arrangement having disposed on a predetermined position of an edge of a circumference of said aperture, wherein said printing fluid droplet tail release guide arrangement comprises a pointed structure of essentially pyramidal shape a base of which rests on an inner surface wall of said nozzle chamber and a pointed tip of which protrudes towards the center of said aperture.

3. An inkjet print head comprising: at least one nozzle chamber, having a nozzle aperture defined in one wall thereof for the ejection of printing fluid out of said aperture, a printing fluid supply channel interconnected with said nozzle chamber; and a printing fluid droplet tail release guide arrangement having disposed on a predetermined position of an edge of a circumference of said aperture, wherein said printing fluid droplet tail release guide arrangement comprises a recessed section of essentially triangular shape in an inner surface wall of said nozzle chamber a base of which rests in the plane of said aperture and a point of which is directed inwards of said nozzle chamber.

4. An inkjet print head comprising: at least one nozzle chamber, having a nozzle aperture defined in one wall thereof for the ejection of printing fluid out of said aperture, a printing fluid supply channel interconnected with said nozzle chamber; and a printing fluid droplet tail release guide arrangement having disposed on a predetermined position of an edge of a circumference of said aperture, wherein said printing fluid droplet tail release guide arrangement comprises a recessed section of essentially triangular pyramidal shape in an inner surface wall of said nozzle chamber a base of which rests in the plane of said aperture and a point of which is directed inwards of said nozzle chamber.

5. A method for increasing droplet placement accuracy in an inkjet print head having at least one nozzle chamber with a nozzle aperture defined in one wall thereof for the ejection of printing fluid out of said aperture, comprising providing a printing fluid droplet tail release guide arrangement disposed on a predetermined position of an edge of a circumference of said aperture, wherein said printing fluid droplet tail release guide arrangement is a bar of essentially triangular cross-section such that a base thereof will rest on an inner surface of said nozzle chamber and such that a pointed edge thereof protrudes towards the center of said aperture and directing said bar such that it extends along said inner surface inwards of said nozzle chamber.

6. A method for increasing droplet placement accuracy in an inkjet print head having at least one nozzle chamber with a nozzle aperture defined in one wall thereof for the ejection of printing fluid out of said aperture, comprising providing a printing fluid droplet tail release guide arrangement disposed on a predetermined position of an edge of a circumference of said aperture, wherein said printing fluid droplet tail release guide arrangement is a pointed structure of essentially pyramidal shape such that a base thereof rests on an inner surface wall of said nozzle chamber and such that a pointed tip thereof protrudes towards the center of said aperture.

7. A method for increasing droplet placement accuracy in an inkjet print head having at least one nozzle chamber with a nozzle aperture defined in one wall thereof for the ejection of printing fluid out of said aperture, comprising providing a printing fluid droplet tail release guide arrangement disposed on a predetermined position of an edge of a circumference of said aperture, wherein said printing fluid droplet tail release guide arrangement is a recessed section of essentially triangular shape in an inner surface wall of said nozzle chamber such that a base thereof rests in the plane of said aperture and a point thereof is directed inwards of said nozzle chamber.

8. A method for increasing droplet placement accuracy in an inkjet print head having at least one nozzle chamber with a nozzle aperture defined in one wall thereof for the ejection of printing fluid out of said aperture, comprising providing a printing fluid droplet tail release guide arrangement disposed on a predetermined position of an edge of a circumference of said aperture, wherein said printing fluid droplet tail release guide arrangement is a recessed section of essentially triangular pyramidal shape in an inner surface wall of said nozzle chamber such that a base thereof rests in the plane of said aperture and a point thereof is directed inwards of said nozzle chamber.

* * * * *